US011678746B2

(12) United States Patent
Wampold et al.

(10) Patent No.: US 11,678,746 B2
(45) Date of Patent: Jun. 20, 2023

(54) CHAIR FOOT ATTACHMENTS FOR IMPROVING FOCUS

(71) Applicant: Bouncyband LLC, Glastonbury, CT (US)

(72) Inventors: Stephen G. Wampold, Marlborough, CT (US); Douglas F. Melville, Simsbury, CT (US)

(73) Assignee: Bouncyband LLC, Glastonbury, CT (US)

( * ) Notice: Subject to any disclaimer, the term of this patent is extended or adjusted under 35 U.S.C. 154(b) by 0 days.

(21) Appl. No.: 17/742,367

(22) Filed: May 11, 2022

(65) Prior Publication Data

US 2023/0105643 A1 Apr. 6, 2023

Related U.S. Application Data

(60) Provisional application No. 63/187,384, filed on May 11, 2021.

(51) Int. Cl.

| | |
|---|---|
| ***A47B 91/12*** | (2006.01) |
| ***A47C 31/00*** | (2006.01) |
| ***A47C 7/62*** | (2006.01) |

(52) U.S. Cl.
CPC ..... *A47C 7/62* (2013.01); *A47B 91/12* (2013.01); *A47C 31/00* (2013.01)

(58) Field of Classification Search
CPC ..... A47B 91/04; A47B 91/12; A47B 91/16; A47C 31/00; A47C 7/62
See application file for complete search history.

(56) References Cited

U.S. PATENT DOCUMENTS

| | | | | |
|---|---|---|---|---|
| 5,924,661 | A * | 7/1999 | Chernack | A47C 7/008 248/188.2 |
| 2017/0143123 | A1* | 5/2017 | Penn | A47C 3/02 |
| 2017/0224113 | A1* | 8/2017 | Heege | A47B 91/12 |
| 2021/0007482 | A1* | 1/2021 | Phipps | A47B 91/12 |

FOREIGN PATENT DOCUMENTS

| | | | | |
|---|---|---|---|---|
| CN | 104273959 | A * | 1/2015 | |
| CN | 104433395 | A * | 3/2015 | |
| CN | 113040551 | A * | 6/2021 | A47C 4/02 |
| DE | 202019104396 | U1 * | 9/2019 | |
| KR | 200393260 | Y1 * | 1/2005 | |
| KR | 20090128931 | A * | 12/2009 | |
| KR | 20130006504 | U * | 11/2013 | |
| KR | 20170136185 | A * | 12/2017 | |
| KR | 20180051067 | A * | 5/2018 | |
| KR | 20190068405 | A * | 6/2019 | |
| KR | 20210126866 | A * | 10/2021 | |
| KR | 102366938 | B1 * | 2/2022 | |

* cited by examiner

*Primary Examiner* — Timothy J Brindley
(74) *Attorney, Agent, or Firm* — Cooper & Maersch LLC; Lorri W. Cooper

(57) ABSTRACT

A chair foot attachment for improving focus is a flexible hollow member having a height with side walls defining bottom edges of the hollow member and having an upper wall with a cavity extending downwardly into the hollow member from the upper wall. The cavity extends only partially into the hollow member and defines a cavity height that is less than the height of the hollow member. The cavity has an upwardly facing bottom surface for abutting a bottom of a chair foot when the chair foot is installed in the cavity. When a chair foot is positioned in the cavity, it permits an associated chair to wobble.

19 Claims, 3 Drawing Sheets

CHAIR FOOT ATTACHMENTS FOR IMPROVING FOCUS

CROSS-REFERENCE TO RELATED APPLICATION

This application claims priority to U.S. Provisional Application No. 63/187,384, filed May 11, 2021, the disclosure of which is incorporated herein by reference in its entirety.

FIELD

The present invention concerns a device that is attached to chair legs and helps students to improve their focus.

BACKGROUND

Children often have excess energy and trouble focusing on schoolwork. It is desirable to provide children and students an outlet for expending energy, and alleviating anxiety, hyperactivity, and boredom. Children often rock back and forth in their seats. Constant motion has a calming influence that helps fidgeting children to expel energy while seated, reducing stress, and increasing their ability to focus. Greater focus leads to higher grades and improved academic performance. Rocking in all directions also engages and strengthens core muscles, resulting in better posture.

SUMMARY

Attachments for chair legs transform a standard school chair into a wobbling chair that enables children to expend excess energy while working, which assists in alleviating anxiety, hyperactivity, and boredom.

DETAILED DESCRIPTION

Figure 1:
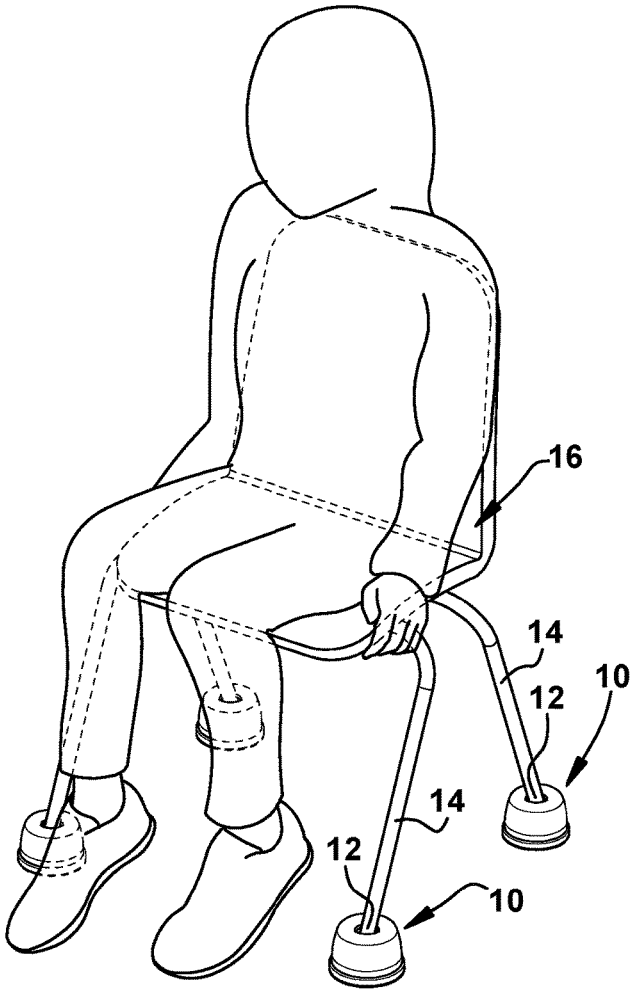
FIG. 1 depicts a student sitting on a classroom chair, with the chair foot attachments installed at the base or foot of each chair leg.
Figure 2:
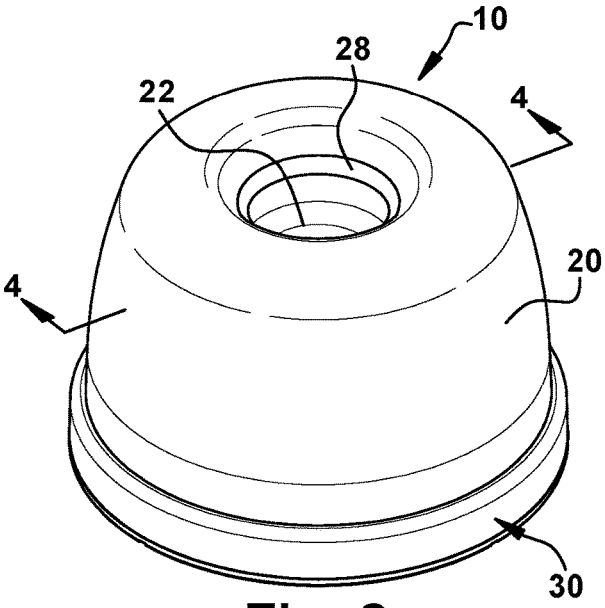
FIG. 2 depicts a perspective view of a chair foot attachment for a single leg of a chair according to the invention.
Figure 3:
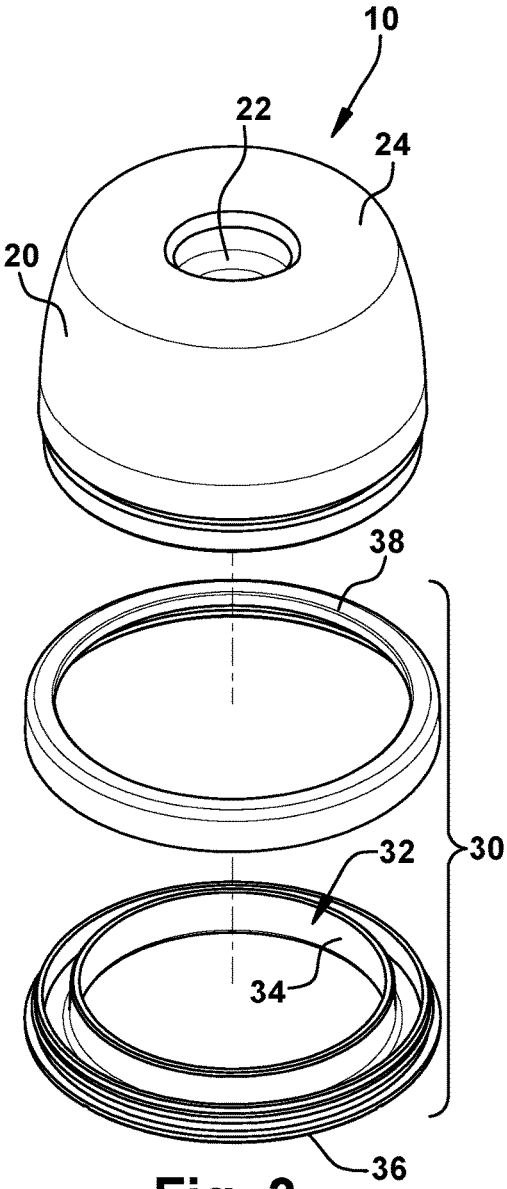
FIG. 3 depicts an exploded view of the chair foot attachment of FIG. 2.
Figure 4:
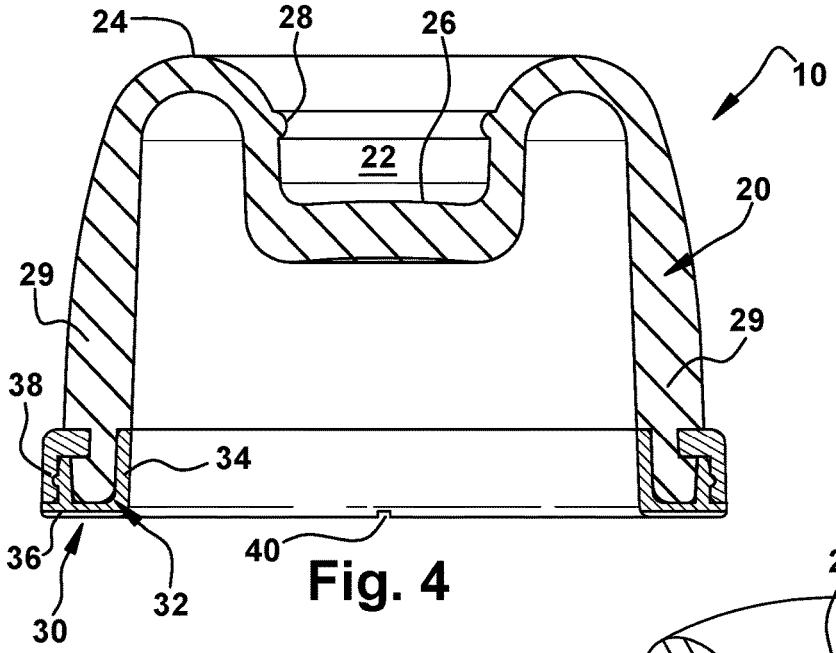
FIG. 4 depicts a cross-sectional view of the chair foot attachment of FIG. 2 taken along line 4-4 in FIG. 2.
Figure 5:
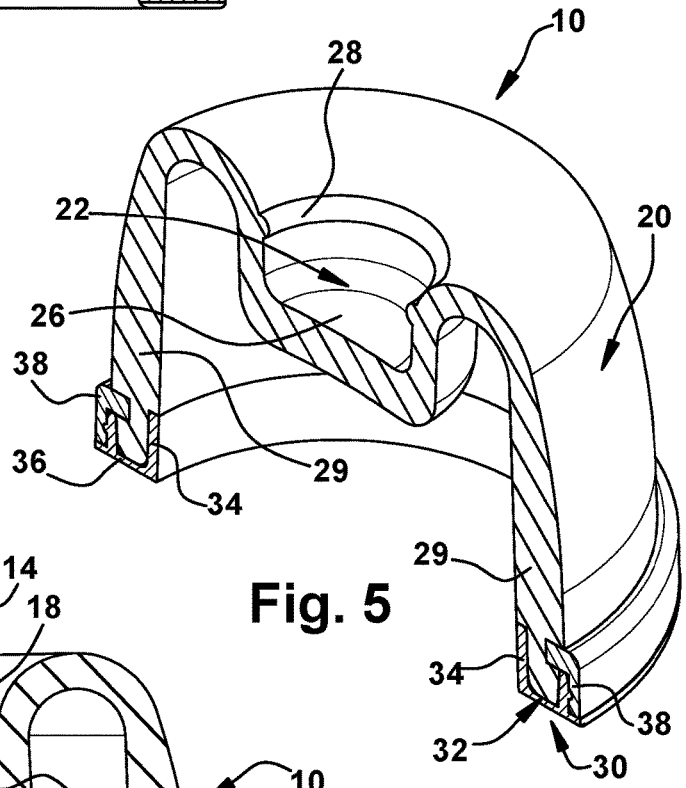
FIG. 5 depicts a perspective cross-sectional view of the chair leg attachment of FIG. 4.
Figure 6:
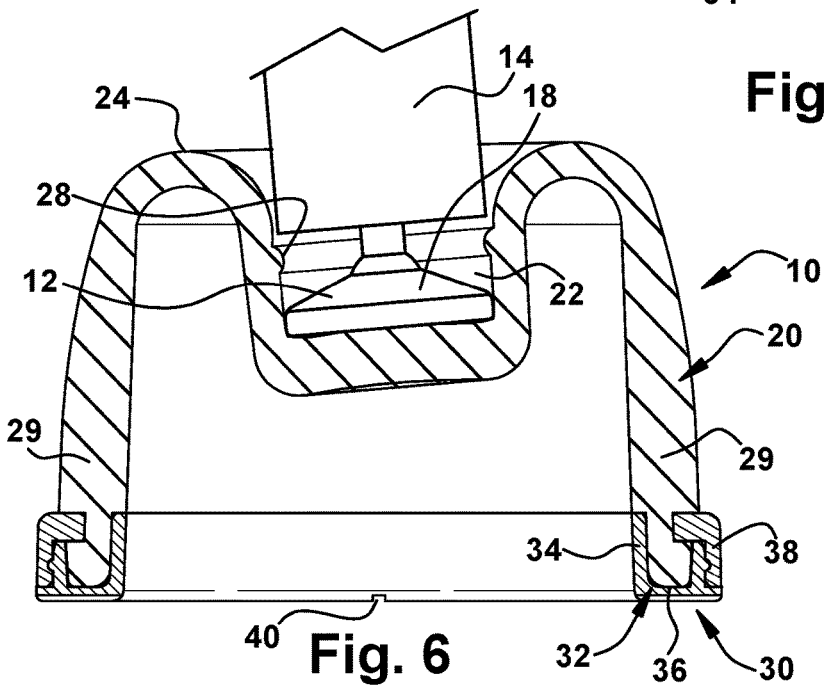
FIG. 6 depicts a cross-sectional view of the chair foot attachment of FIG. 4 with the base of a chair leg installed inside the chair foot attachment.
Figure 7:
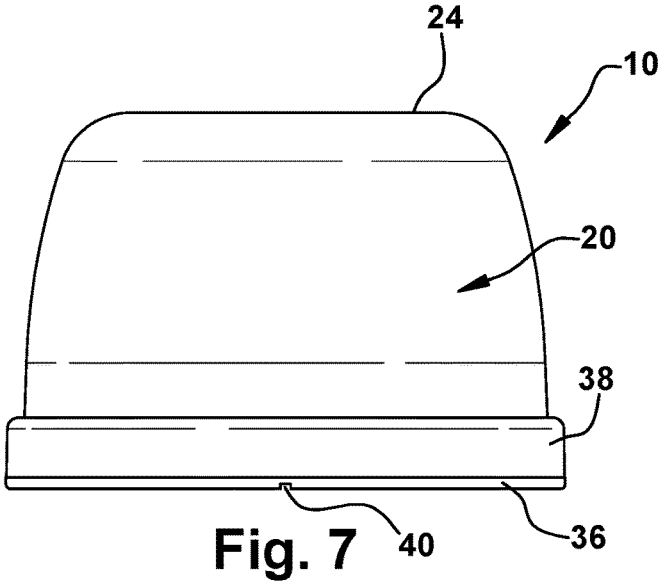
FIG. 7 depicts a side view of the chair foot attachment of FIG. 2.
Figure 8:
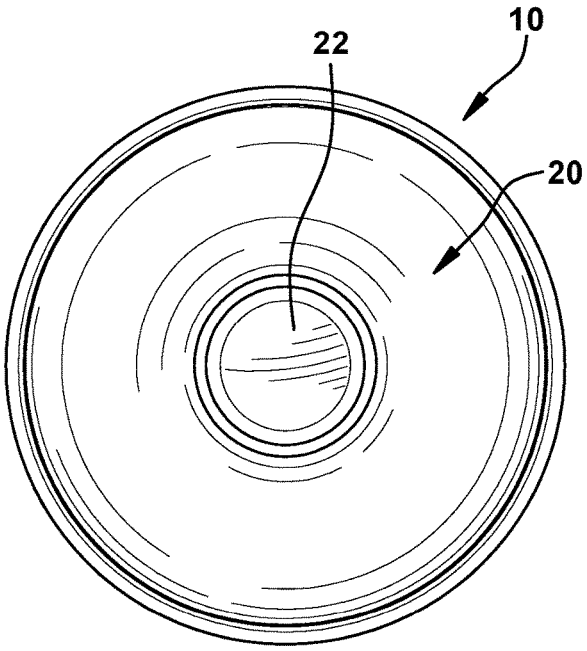
FIG. 8 depicts a top view of the chair foot attachment of FIG. 2.
Figure 9:
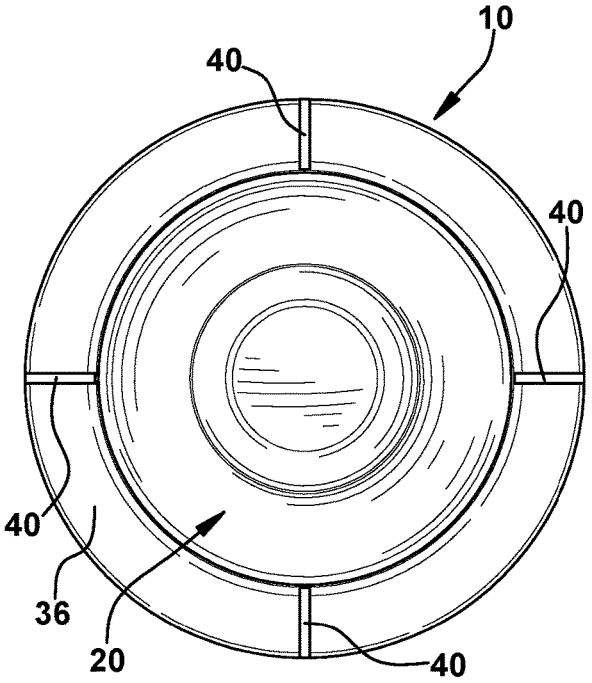
FIG. 9 depicts a bottom view of the chair foot attachment of FIG. 2.

A chair foot attachment 10 is provided for installing onto the base or foot 12 of a chair leg 14. The chair foot attachment 10 permits a student sitting on the chair to be able to wiggle and wobble on the chair 16 more freely, without having to lift the chair legs 14 off the floor, and without disturbing others in their immediate vicinity. The chair foot attachment 10 is shown attached to all four chair legs 14 in FIG. 1 hereof. Typically, for chairs 16 having four legs 14, four chair foot attachments 10 are installed on a chair 16 so that each leg 14 has an attachment.

It should be noted that it is possible that fewer than four chair foot attachments 10 could be used while still permitting a student to wiggle and wobble on the chair 16 more freely. For example, two chair foot attachments 10 could be installed on two of the chair legs 14, such as the two front legs, two rear legs, or diagonally opposed legs, while still providing the user with the ability to wiggle and wobble on the chair 16.

Movement by students using the chair foot attachments 10 can increase blood flow, which enables children a greater ability to focus. At the same time, constant motion can cause a calming influence, which can help to reduce stress and increase the time a student stays on task.

Installation of the chair foot attachment 10 is simple in that a user only needs to snap the attachment onto a foot 12 of a chair 16. The design depicted can be installed on a standard round school chair glide 18, measuring between approximately 1.125 inches and 1.25 inches in diameter, without requiring any tools. A user simply positions the foot 12 of the chair 16 into the center of the chair foot attachment 10 and press downwardly until the chair foot attachment 10 is seated firmly around the foot 12 of the chair leg 14. The design may be used on many different sized feet 12 of chair legs 14.

The chair foot attachment 10 shown in the Figures has a size of about 2.6" in height and about 3.8" in diameter. The chair foot attachment 10 can be sized in different sizes depending upon the foot size of the chair 16.

As discussed below, the base 12 of the chair foot attachment 10 permits the attachment 10 to be effectively used on tile, wood, and carpeted floors. In particular, the chair foot attachment 10 has a base that permits the chair foot attachment 10 to slide on many different types of surfaces.

The chair foot attachment 10 includes an upper member 20 that is dome-shaped, having a flattened upper profile. A cavity 22 extends inwardly into the dome 20 from the upper surface 24 thereof. The cavity 22 may be centrally disposed, as shown, and includes an upwardly facing bottom surface 26 that abuts the bottom of a chair leg 16 when the chair leg is installed in the cavity 22. The cavity 22 is shown as having a cylindrical shape. A ring-shaped protrusion 28 extends inwardly into the cylinder between the bottom surface 26 of the cavity 22 and the upper surface 24 of the upper member 20. The protrusion 28 assists in retaining the chair foot 12 in the cavity 22. The outer legs 30 of the upper member 20 may have a thickness that is greater than the thickness of the upper member 20 at its upper surface 24. The shape of the upper member 20 provides a spring-like member. The protrusion 28 may be optional.

In one embodiment, the upper member 20 may have an outer diameter of about 3.6" and a height of about 2.5". The cavity may have an inner diameter of about 1.2" and the protrusion 28 has an inner diameter of about 1.1". The bottom surface 26 of the cavity 22 may be spaced about 1.4" from the bottom surface of the upper member 20.

The upper member 20 may be made of a flexible material, such as rubber. One type of rubber that may be used is a combination of natural rubber and SBR (styrene-butadiene rubber).

The chair foot attachment 10 is depicted as including a base member 30 having two parts, both of which are substantially ring-shaped. The base member 30 includes an inner member 32 that forms an inner wall 34 and a bottom wall 36 of the base member 30, and an outer member 38 that forms an outer wall of the base member 30. The inner and outer members 32, 38 are configured to snap together with appropriate attachment surfaces, as known by those of skill in the art.

The upper member 20 may include a shape, including grooves for mating with the base member 30, as shown in FIGS. 3-6. An interior groove may be provided so that the inner member is seated on inner member inner side, so it is flush with the inner side of the inner wall, as shown best in FIGS. 4-6. The base member 30 traps the bottom end of the legs 12 of the upper member 20. The base member 30 may provide a press fit to attach the base member 30 to the upper member 20. Alternatively, or in addition thereto, the base member 30 may be adhered to the upper member 20, welded to the upper member 20, or otherwise attached to the upper member 20.

As discussed above, the base member 30 is made of a material that permits the chair foot attachment 10 to slide more easily on many different types of surfaces. The base member 30 also has grooves 40 spaced apart on the bottom wall 36 that prevent the base member 30 from suctioning onto a surface, further promoting sliding of the base member on an underlying surface. The grooves 40 extend between the inside of the dome and the exterior of the dome, permitting air to transfer between the inside and exterior of the dome. The base member 30 may be made of a material such as plastic. One type of plastic that can be used is COPP (Copolymerized Polypropylene). Other materials may alternatively be used.

Both the base member 30 and the upper member 20 are shown as being symmetrical. Alternatively, although not shown, the base member and upper member could be non-symmetrical. The base member 30 may be optional.

In a first embodiment, a chair foot attachment for improving focus includes a flexible upper member. The upper member has a height with side walls defining bottom edges of the upper member and an upper wall with a cavity extending downwardly into the upper member from the upper wall. The cavity extends only partially into the upper member and defines a cavity height that is less than the height of the upper member. The cavity has an upwardly facing bottom surface for abutting a bottom of a chair foot when the chair foot is installed in the cavity. When the chair foot is positioned in the cavity, it permits an associated chair to wobble.

The upper member may be at least in part hollow. The upper member may have a flattened upper profile. The cavity may be centrally disposed. The cavity may have a substantially cylindrical shape. The cavity may include a ring-shaped protrusion adjacent the bottom surface of the cavity for assisting in retaining a chair foot in the cavity. The side walls of the upper member may have a thickness that is greater than the thickness of the upper wall of the hollow member. The upper member may have an outer diameter of about 3.6" and a height of about 2.5". The cavity may have an inner diameter of about 1.2" and the protrusion may have an inner diameter of about 1.1". The bottom surface of the cavity 22 may be spaced about 1.4" from the bottom edges of the hollow member.

The upper member may be made of a flexible material. The flexible material may be rubber.

The chair foot attachment may also include a base member coupled to the bottom edges of the hollow member. The base member may have an inner member and an outer member. The inner member may form an inner wall and a bottom wall of the base member. The outer member may form an outer wall of the base member. The inner and outer members may be configured to snap together via attachment surfaces. The inner member may be ring-shaped, and the outer member may be ring-shaped.

The upper member may include grooves for mating with the base member, including an interior groove for coupling with the inner member. The base member may be configured to trap the bottom edges of the upper member. The base member may have a bottom surface with grooves to deter the base member from suctioning to the floor during use. The grooves may permit air to transfer between the inside and exterior of the upper member. The base member may be substantially symmetrical, and the upper member may be substantially symmetrical.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary.

What is claimed is:

1. A chair foot attachment for improving focus comprises:

a flexible upper member having a height with side walls defining bottom edges of the upper member and having an upper wall with a cavity extending downwardly into the upper member from the upper wall, with the cavity extending only partially into the upper member and defining a cavity height that is less than the height of the upper member, and the cavity has an upwardly facing bottom surface for abutting a bottom of a chair foot when the chair foot is installed in the cavity;

wherein when a chair foot is positioned in the cavity, it permits an associated chair to wobble.

2. The chair foot attachment of claim 1, wherein the upper member is at least in part hollow.

3. The chair foot attachment of claim 2, wherein the upper member has a flattened upper profile.

4. The chair foot attachment of claim 2, wherein the cavity is centrally disposed.

5. The chair foot attachment of claim 2, wherein the cavity has a substantially cylindrical shape.

6. The chair foot attachment of claim 2, wherein the cavity includes a ring-shaped protrusion adjacent the bottom surface of the cavity for assisting in retaining a chair foot in the cavity.

7. The chair foot attachment of claim 2, wherein the side walls of the hollow member have a thickness that is greater than the thickness of the upper wall of the hollow member.

8. The chair foot attachment of claim 2, wherein the upper member has an outer diameter of about 3.6" and a height of about 2.5", the cavity has an inner diameter of about 1.2" and the protrusion has an inner diameter of about 1.1", and the bottom surface of the cavity 22 is spaced about 1.4" from the bottom edges of the hollow member.

9. The chair foot attachment of claim 2, wherein the upper member is made of a flexible material.

10. The chair foot attachment of claim 9, wherein the flexible material is rubber.

11. The chair foot of attachment of claim 2, further comprising a base member coupled to the bottom edges of the hollow member.

12. The chair foot attachment of claim 11, wherein the base member comprises:

an inner member that forms an inner wall and a bottom wall of the base member; and an outer member that forms an outer wall of the base member.

13. The chair foot attachment of claim 12, wherein the inner and outer members are configured to snap together via attachment surfaces.

14. The chair foot attachment of claim 12, wherein the inner member is ring-shaped, and the outer member is ring-shaped.

15. The chair foot attachment of claim 12, wherein the upper member includes grooves for mating with the base member, including an interior groove for coupling with the inner member.

16. The chair foot attachment of claim 11, wherein the base member is configured to trap the bottom edges of the upper member.

17. The chair foot attachment of claim 11, wherein the base member has a bottom surface with grooves to deter the base member from suctioning to the floor during use.

18. The chair foot attachment of claim 17, wherein the grooves permit air to transfer between the inside and exterior of the upper member.

19. The chair foot attachment of claim 11, wherein the base member is substantially symmetrical, and the upper member is substantially symmetrical.

* * * * *